US007384377B2

(12) United States Patent
Berman

(10) Patent No.: US 7,384,377 B2
(45) Date of Patent: Jun. 10, 2008

(54) METHOD AND APPARATUS FOR TRAINING FACIAL MUSCLES TO REDUCE WRINKLES

(76) Inventor: Ellen R. Berman, 84 Silver Spring Rd., Ridgefield, CT (US) 06877-5415

( * ) Notice: Subject to any disclaimer, the term of this patent is extended or adjusted under 35 U.S.C. 154(b) by 8 days.

(21) Appl. No.: 11/314,781

(22) Filed: Dec. 20, 2005

(65) Prior Publication Data

US 2006/0135319 A1 Jun. 22, 2006

Related U.S. Application Data

(60) Provisional application No. 60/637,931, filed on Dec. 21, 2004.

(51) Int. Cl.
*A63B 23/03* (2006.01)

(52) U.S. Cl. ..... 482/11; 601/15

(58) Field of Classification Search ..... 482/44; 601/15–19, 103, 112, 114; 607/109; 128/857–858; 2/9, 173, 206

See application file for complete search history.

(56) References Cited

U.S. PATENT DOCUMENTS

| | | | | | |
|---|---|---|---|---|---|
| 1,693,452 | A | | 11/1928 | McCune | |
| 2,882,892 | A | | 4/1959 | Kosior | |
| 3,441,016 | A | * | 4/1969 | Kanbar | 601/136 |
| 3,507,493 | A | | 4/1970 | Robins | |
| 3,536,064 | A | * | 10/1970 | Ochi et al. | 601/93 |
| 3,557,781 | A | | 1/1971 | Kaye, Sr. | |
| 3,699,952 | A | * | 10/1972 | Waters et al. | 601/18 |
| 3,733,634 | A | | 5/1973 | Golbe | |
| 4,052,981 | A | * | 10/1977 | Bachmann | 601/71 |
| 4,189,141 | A | * | 2/1980 | Rooney | 482/11 |
| 4,404,965 | A | | 9/1983 | Waits et al. | |
| 4,574,787 | A | | 3/1986 | Jacobs | |
| 4,787,372 | A | * | 11/1988 | Ramseyer | 601/103 |
| 4,841,954 | A | * | 6/1989 | Kalsi | 601/71 |
| 4,892,092 | A | | 1/1990 | Klein | |
| 4,957,480 | A | * | 9/1990 | Morenings | 604/20 |
| 5,072,724 | A | * | 12/1991 | Marcus | 601/148 |
| 5,396,881 | A | | 3/1995 | Klein | |
| 5,728,028 | A | * | 3/1998 | Dusch | 482/11 |
| 5,767,634 | A | | 6/1998 | Taylor et al. | |
| 5,803,916 | A | | 9/1998 | Kuznets et al. | |
| 5,840,048 | A | | 11/1998 | Cheng | |
| 5,928,262 | A | | 7/1999 | Harber | |
| 6,312,397 | B1 | | 11/2001 | Gebhard | |
| 6,730,050 | B2 | * | 5/2004 | Huang | 601/93 |
| 2001/0027280 | A1 | * | 10/2001 | Huang | 601/108 |
| 2003/0163068 | A1 | | 8/2003 | Kang | |

OTHER PUBLICATIONS

International Search Report for International Appln. No. PCT/US05/46414 dated Jul. 18, 2006.

* cited by examiner

*Primary Examiner*—Lori Amerson
(74) *Attorney, Agent, or Firm*—McCormick, Paulding & Huber

(57) ABSTRACT

Method and apparatus for training facial muscles to reduce wrinkles employs a flexible stretchable membrane held in contact with the skin over a muscle group while manipulating a hand-held device with a motorized rotary brush over the membrane, so that the bristles stimulate and train the muscle group while the flexible membrane protects and stabilizes the skin.

30 Claims, 7 Drawing Sheets

METHOD AND APPARATUS FOR TRAINING FACIAL MUSCLES TO REDUCE WRINKLES

CROSS REFERENCE TO RELATED APPLICATION

This application claims the benefit of U.S. Provisional Application No. 60/637,931, filed on Dec. 21, 2004, the disclosure of which are herein incorporated by reference in its entirety.

TECHNICAL FIELD

This invention relates to method and apparatus for reducing facial wrinkles. More particularly, the invention relates to a method and apparatus for improving and enhancing the physical appearance of the human face, particularly the eyes, to impart a more youthful appearance, by training, strengthening and toning the facial muscles, wherein the procedure is carried out using a hand-manipulated muscle training device in conjunction with a protective flexible membrane in contact with the area being treated.

BACKGROUND ART

The skin of the human being, for example, is the largest organ and comprises about one-sixth of the total body weight. It protects the human being from ultraviolet rays; from mechanical, chemical and thermal injuries; from bacterial invasions and from dehydration and water penetration.

The skin is also the largest sensory organ, and contains nerve endings for touch, pain, pressure and temperature.

The three main layers of the skin comprise the epidermis, which is dry dead skin, nonvascular; the dermis, which is flexible, elastic and vascular tissue; and the subcutaneous, which are mostly fatty tissues.

The layers of the epidermis comprise the stratum corneum, which is a horny layer, made up of flattened dead cells; the stratum lucidum, which is a thin homogeneous layer; the stratum grandulosum which are granules effecting keratinization; the stratum spinosum, which are cells in the growing process; and the stratum germinativum, which is where new cells are produced and is also the location of melanin, a dark pigment.

The layers of the dermis comprise the stratum papillare, which are small, sensitive vascular papillare; and the stratum reticulare, which is the connective tissue composed of collagen.

The human body is about one-half muscle and comprises three types of muscles: (1) voluntary-striated, skeletal muscles; (2) involuntary-smooth visceral muscles; and (3) intermediate-cardiac muscles. With the exception of the eyelid muscles (obiculari oculi-involuntary) the present invention is concerned only with the voluntary muscles.

Muscle cells, muscle fibers, grow by enlargement not by cell division. Once a muscle fiber is destroyed it will not regenerate. However, surrounding muscle fibers may enlarge and take over its function. A decrease in muscle size due to lack of use is called "atrophy." If a muscle is re-inervated within three to four months after loss of use, full function can usually be restored, but after four months of disuse muscle fibers begin to die. After about two years of disuse, usually no function can be restored to muscles, and the muscle fibers become restricted by fat and fibrous tissue.

Each muscle fiber contains thousands of myofibrils which run parallel with the muscle fibers and are the contractile elements of the muscle fiber. Each myofibril contains myosin (thick) and actin (thin) filaments which actually cause the contraction. When an impulse for a contraction is received, crossbridges located on the myosin filaments pull like oars causing a creeping motion. Muscle response to an impulse is an "all or nothing" response. Either the impulse is strong enough to cause a contraction in a muscle fiber, or it is not strong enough. If the impulse is strong enough, the contraction will be along the entire length of the muscle fiber. The more muscle fibers that are excited, the stronger the contraction will be.

Each muscle fiber has a neuromuscular function located at the middle of the fiber. This is the point where the nerve fiber connects with the muscle fiber, and therefore, is where a muscle fiber is best stimulated. The purpose of the neuromuscular fiber is to amplify weak impulses so that they are strong enough to cause a contraction. A motor point is a point of excessive excitability. This would be a location where several neuromuscular functions were found very close to each other.

Muscle fibers are individual entities, and can act independently of each other or in conjunction with each other. Muscle fibers run substantially parallel to one another the entire length of the muscle, and are separated from each other by a connective sheath called the endomysium. Muscle fibers are grouped into bundles called fasciculi. These fasciculi are separated from each other by a connective sheath called the perimysium. The fasciculi are grouped together to form muscles. Each muscle is enveloped by a connective tissue called the epimysium. Large blood vessels and nerves enter the muscle through the epimysium, and then begin to divide and branch until they supply every muscle fiber. Every muscle fiber has its own source of nutrition and stimulation. All of the muscle fibers that are stimulated by a single nerve fiber are called a "motor unit." Each motor unit contains an average of 150 muscle fibers.

Muscle tone is the normal degree of tension in a muscle at rest, or the resistance of a muscle to passive elongation or stretch. Muscle tone in the human body is created and maintained by a steady discharge of motor impulses from the brain and feedback from the spinal cord via muscle spindles. The brain, via the central nervous system, sends steady impulses to the muscle causing it to contract. Muscle spindles, which are specialized fibers in the muscle, detect the contraction and send a message to the spinal cord via the peripheral nervous system. The spinal column sends another motor impulse back to the same muscle causing another contraction. This is how tension is maintained in the muscle. As time between the impulses from the brain increases due to age, sickness or accident, the tension or tone in the muscle decreases. There are several factors that can affect muscle tone (some increase it while others decrease it). The following factors will reduce muscle tone: (1) neurologic deficiencies, such as trauma, aging, diseases, and nutritional deficiencies; (2) metabolic deficiencies, such as aging, nutritional deficiencies, and poor circulation; (3) physical effects, such as trauma, stress, environment and lifestyle; and (4) mental effects.

The following factors will increase muscle tone: (1) neurologic support, such as removal of interference, physiotherapy, nutrition, and electroneurological stimulation; (2) metabolic support, such as increase of circulation by electrostimulation, exercise, nutrition, iontophoresis, and massage; (3) physical support, such as electrotone and exercise tone; and (4) mental support, such as education and positive habits.

U.S. Pat. No. 4,957,480, issued Sep. 18, 1990 to Morenings describes a Method of toning the muscles and tissues of the human face by stimulating the motor nerves and hence cause contractions of the muscles of the human face by applying predetermined galvanic currents, frequencies, and polarities through moistened tips of electrodes continually moistened with a liquid solution of positively and negatively charged particles for introduction into the tissues for nourishment of the muscles and surrounding facial tissues. The present invention does not utilize electrodes to apply galvanic currents, frequencies or polarities, which require special equipment and techniques.

Wrinkles in the skin begin to form as the skin ages. Wrinkles also are due to lack of muscle tone in the muscle fibers underlying the skin and appear to run in a direction generally at right angles to the direction of the muscle fibers or the fasciculi (bundles of fibers). The facial muscles are arranged in a complex pattern. A study of the orientation of the muscle fibers in the various groups of muscles makes it clear why well-known facial wrinkle patterns, such as "frown lines" in the forehead, "crow's feet" at the edge of the eyes, etc. appear and become more prominent as time goes on.

The prior art illustrates that there have been two main approaches to reduction or alleviation of facial wrinkles: (1) devices used directly on the skin, such as vibratory or rotary massagers, heaters or electrical instruments, and (2) special masks incorporating active elements such as pressurized fluid chambers, vibrators or weights.

Examples of the first type operating directly in contact with the skin are seen in the following patents.

U.S. Pat. No. 6,312,397 to Gebhard shows a handheld facial iron with a spoon shaped surface for applying pressure and warming the facial muscles. It uses a rechargeable power source and is applied directly to the face.

U.S. Pat. No. 6,730,050 to Huang shows a vibratory hand-held electric massager with two reciprocating heads that move back and forth laterally toward one another (as opposed to up and down as in prior art FIGS. 7 and 8.

U.S. Pat. No. 4,404,965 to Waits uses gears and eccentric rotating elements to create a "circular and spiral motion (FIG. 8) duplicating finger massaging.

U.S. Pat. No. 3,441,016 to Kanbar shows a vibratory massager with a special head fitting an electric toothbrush. Slots or grooves hold facial cream.

U.S. Pat. No. 3,733,634, issued May 22, 1973 to Golbe describes a hand-held skin cleansing device with battery-powered motor, speed reduction gearing and a rotary brush with axially extending bristles.

U.S. Pat. No. 3,699,952 issued Oct. 24, 1972 to Waters shows a hand-held battery-powered device for massaging or skin conditioning utilizing an orbitally-driven brush, and U.S. Pat. No. 5,803,916 issued Sep. 8, 1998 to Kuznets et al shows a body and joints massage device with self rotating massage elements with passively rotating rollers.

U.S. Pat. No. 5,840,048 issued Nov. 24, 1998 to Cheng shows a skin brush massage method for treating the skin by brushing designated areas of the skin with soft nylon bristles in a clockwise direction in a designated sequence.

A commercially available example of the first type is a Microdermabrasion System with several interchangeable facial attachments, including cleansing brush, rolling massager and suction cups. The attachments are operated by a facial tool with a rechargeable battery and recharging stand. The Microdermabrasion unit is sold by The Sharper Image, as Model HF 650, to be used with facial cream to deep dean the skin and used directly on the face after opening the pores with a shower.

Examples of the second type using facemasks are seen in the following patents.

U.S. Pat. No. 5,928,262 to Harber shows a double layer facemask of lightweight felt with vibrators between the layers located as shown to vibrate specified muscles.

U.S. Pat. No. 5,072,724 to Marcus shows an elastic mask with confined liquid chambers and vibrator elements to cause the liquid to vibrate.

U.S. Pat. No. 4,052,981 to Bachmann shows a somewhat elastic facemask with individual compressible "fingers" 56 and means to vibrate the fingers with variable speed.

U.S. Pat. No. 2,882,892 to Kosior shows a perforated flexible mask with weights (like 23) hung at particular locations to increase pressure when the user is lying face up.

U.S. Pat. No. 1,693,452 to McCune (1928) shows a facemask of elastic silk to hold (not exercise) sagging facial skin along with facial cream.

U.S. Pat. No. 3,507,493 to Robins shows an eye muscle exerciser of a rigid support and a cushioning liner against the eyes. The user moves the eye muscles against the liner.

U.S. Pat. No. 4,841,954 to Kalsi shows an occulo-facial massager with a rigid holder for a cushioning foam rubber layer against the eye area and a vibrator mechanism.

U.S. Pat. No. 5,396,881 issued Mar. 14, 1995 to Klein shows a facial mask for effecting toning of facial muscles by applying suction between two layers of flexible sheet material and pressing the mask against the face with fluid pressure.

U.S. Pat. No. 4,892,092 issued Jan. 9, 1990 to Klein shows a facial mask with shaped pressure applicators and an expansible chamber for applying pressure to the terminal points of selected facial muscles, and U.S. Pat. No. 3,557,781 issued Jan. 26, 1971 to Kaye shows a vibratable mask device for contacting facial and chin areas with foam and vibrating elements to impart vibrations through the foam.

The foregoing patents of the first type have the possibility of damage or injury to the skin because they act directly on the unprotected and delicate facial skin, while the patents of the second type are complicated and expensive to make and require fitting to individual faces in many cases.

Accordingly, one object of the invention is to provide a method and apparatus for reducing facial wrinkles that effectively tones and trains the facial muscles while protecting and stabilizing the facial skin during the procedure.

Another object of the invention is to provide a method and apparatus for reducing facial wrinkles, which allows the user to adjust the treatment and the type of applicator to correspond to the particular area being trained.

Still another object of the invention is to provide a simple and flexible procedure and tools for carrying out the procedure that effectively reduce wrinkles by training the facial muscles underlying the wrinkles.

SUMMARY OF THE INVENTION

Briefly stated the invention comprises a method for training facial muscles to reduce wrinkles in the skin overlying said facial muscles on the face of a user, said facial muscles comprising a plurality of fibers oriented substantially parallel to one another, said method comprising the steps of providing a flexible membrane of stretchable elastic fabric having an inner surface and an outer surface, providing a hand-held device having a housing, a power source, a motor connected to be selectively activated by said power source, a motion converter driven by said motor, and a head connected to said motion converter, said head having a plurality of muscle training elements thereon arranged to be moved in a substantially circular direction by said motion converter, pressing said inner surface of the flexible membrane into contact with a portion of said face, pressing the muscle training elements on said head against the outer surface of said membrane so that the muscle training elements move in said circular direction both across and along said plurality of fibers, and manipulating said hand-held device over the outer surface of said membrane to stimulate and train said facial muscles while the flexible membrane protects and stabilizes the skin overlying said muscles.

More specific applications of the method may include the following:

The above method where the facial muscles trained are in the eyelids (orbicularis oculi-involuntary).

The above method where the facial muscles trained are around the eyes (orbicularis oculi-voluntary).

The above method where the facial muscles trained are on the forehead (frontalis).

The above method where the facial muscles trained are around the mouth (orbicularis oris), including the lips.

The above method where the facial muscles trained are on the neck (platysma) and chin (depressor anguli oris).

The above method where the facial muscles trained are on the cheeks (zygomaticus major, zygomaticus minor, risorius, and buccinator).

The invention also comprises apparatus for training facial muscles to reduce wrinkles in the skin overlying said facial muscles on the face of a user, comprising the combination of a flexible membrane of stretchable elastic fabric having an inner surface and an outer surface, and a hand-held device having a housing, a power source, a motor connected to be selectively activated by said power source, a motion converter driven by said motor, and a head connected to said motion converter, said head having a plurality of muscle training elements thereon arranged to be moved in a substantially circular direction by said motion converter, whereby the inner surface of the membrane may be placed in contact with the face and the muscle training elements pressed against the outer surface of the membrane so as to move in said circular direction while the hand-held device is manipulated over the outer surface of the membrane to stimulate and train said facial muscles while the flexible membrane protects and stabilizes the skin overlying said facial muscles.

The above apparatus where the flexible membrane comprises Spandex.

The above apparatus where the flexible membrane comprises Lycra.

The above apparatus where the flexible membrane comprises Dorlastan.

The above apparatus where the head on the hand held device is detachable so as to be replaced by another head with a different type of muscle training elements.

The above apparatus where the motion converter rotates the head about an axis.

The above apparatus where the motion converter orbits the head about an axis.

The above apparatus where the muscle training elements are bristles.

The above apparatus where the muscle training elements are freely rotatable balls.

The above apparatus where the muscle training elements are bumps on fabric.

The above apparatus where the muscle training elements are unwoven fibers.

The above apparatus where the power source is a rechargeable battery.

The above apparatus where the power source is a plug-in adapter with a connecting cord.

The above apparatus where the motion converter is a speed reducing gear train providing a rotating output motion.

The above apparatus where the motion converter employs an eccentric rotating element providing an orbital output motion.

The above apparatus where the motion converter employs a wobble plate and nutating shaft providing an orbital output motion.

The above apparatus where the membrane is a hood.

The above apparatus where the membrane is a face mask.

The above apparatus where the membrane is an eye mask.

The above apparatus where the membrane is in a hand-held rim.

The above apparatus including a heating element in the hand-held device.

The above apparatus including a mist producing element in the hand-held device.

BRIEF DESCRIPTION OF THE DRAWINGS

Other objects and advantages of the invention will become apparent by reference to the following description, taken in connection with the accompanying drawings, in which.

DETAILED DESCRIPTION OF THE PREFERRED EMBODIMENTS

Figure 1:
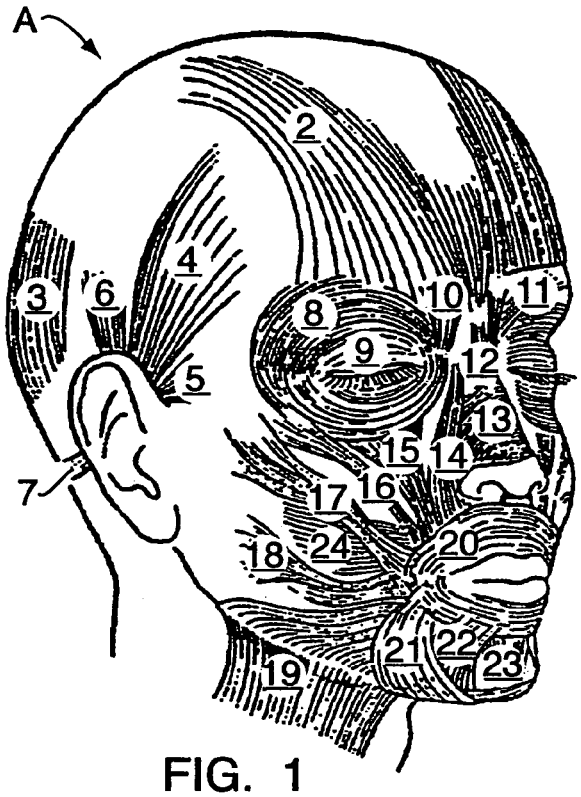
FIG. 1 is a human head with hair and overlying skin tissues removed to show the underlying facial muscles.

Referring to FIG. 1 of the drawing, a human head A is represented with the hair and overlying facial tissues removed to illustrate the underlying muscles controlling the expression of the face. The muscles illustrated are frontalis 2, occipitalis 3, temporalis 4, auricularis anterior 5, auricularis superior 6, auricularis posterior 7, orbicularis oculi (voluntary) 8, orbicularis oculi (involuntary) 9, depressor supercilii 10, corrugator 11, procerus 12, nasalis-compressor naris 13, levator labii superioris nasii 14, levator labii superioris 15, zygomaticus minor 16, zygomaticus major 17, risorius 18, platysma 19, orbicularis oris 20, depressor anguli oris 21, depressor labii inferiores 22, mentalis 23, and buccinator 24.

Figure 2:
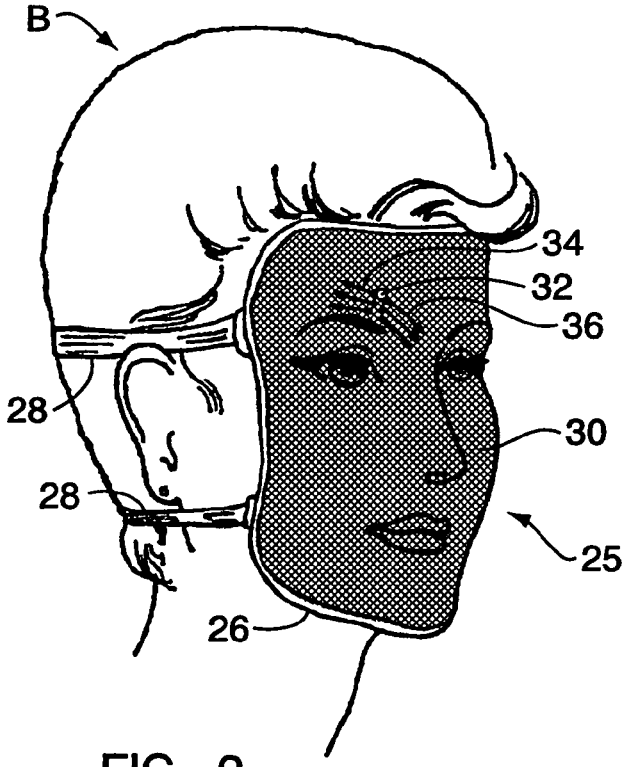
FIG. 2 is a view of a human head with flexible membrane of elastic material in the form of a facemask conforming to the face.

Referring to FIG. 2 of the drawing, a human head B is represented wearing a facemask shown generally at 25. The face mask 25 is supported around the area to be treated by a self-supporting rim 26 of soft, but relatively rigid plastic material, held in place by elastic straps 28. A flexible membrane 30 of stretchable elastic fabric is attached about its periphery to the rim 26 by any suitable means, such as adhesive. The elastic straps and the rim pull the membrane 30 into contact with the face of the user, and the stretchable fabric causes it to conform to the shape of the face in the areas to be treated.

In accordance with the present invention, the flexible membrane may be any of the well-known commercially available materials such as Spandex® or Lycra® fibers woven together with other fibers such as polyester or nylon in various commercially available materials. One preferred material for membrane 30 is a woven fabric of 90% polyester and 10% Spandex®, although many other materials which are thin and which will stretch and conform into intimate contact with the skin may be also suitable. It is desirable that air will permeate freely through the membrane so as not to impair breathing, and also desirable that the membrane be not so thick or densely woven that the user cannot see through the interstices when the material is stretched over the eyes.

In FIG. 2, one of the areas to be treated to train the muscles is shown at reference number 32 to be in the area corresponding to the orbicularis oculi 8 shown in FIG. 1. This is the muscle encircling the eye and underlying the skin that gradually ages to produce wrinkles generally radiating from the eye at right angles to this muscle, e.g. crow's feet. The muscle fibers extend generally parallel to one another from point 32 in the direction indicated by reference numbers 34, 36.

Figure 3:
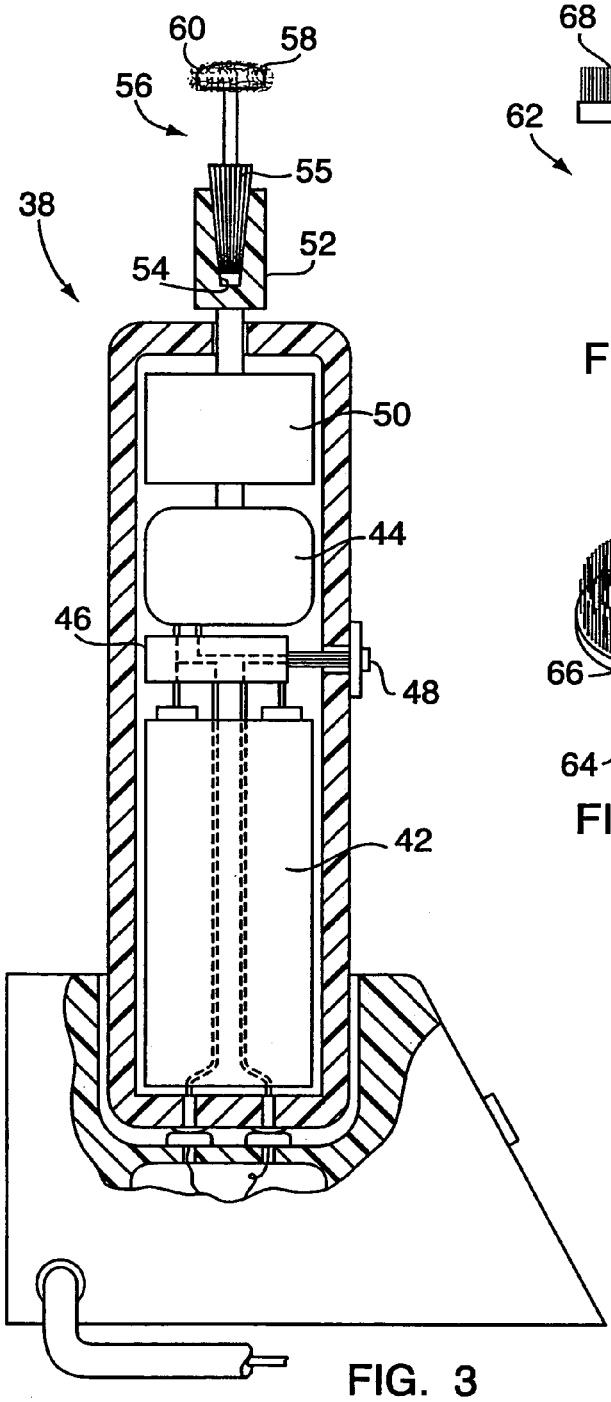
FIG. 3 is an elevation view in cross section of one type of hand-held device for imparting rotary motion to a removable head, shown with a fibrous pad thereon.

Referring to FIG. 3 of the drawing a hand held device for carrying out the method according to the present invention is indicated generally by reference number 38. Device 38 is shown in cross-section and placed, when not in use, in a battery recharging stand, shown generally at 40.

The hand held device 38 includes a housing, a battery 42 serving as a power source, a motor 44 connected to battery 42 though a circuit board 46 to be activated by a manual switch 48. Motor 44 drives a motion converter 50, in this case a speed reducing gear train (not shown), which has its output shaft connected to a chuck 52. Preferably the speed of the motor 44 is reduced to an output speed of about 90 to 120 rpm by the motion converter. Chuck 52 includes a tapered socket 54 receiving the tapered tip 55 of a removable head 56 with a friction fit. The removable head 56 carries a rotary tip 58, which in the case shown supports a ball of unwoven fibers or fuzzy material such as lambs wool or Berber Fleece used to train the muscles of the eyelid. The fibers serve as muscle training elements 60 that are moved in a circular motion by head 56. Challenging the eyelid muscles may also prevent ptosis of the eyelid (drooping) and could prevent the need for possible surgery and/or botox injection.

Figure 4A:
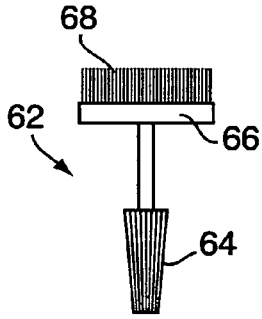
FIGS. 4*a* and 4*b* are elevation and perspective views, respectively, of a removable head having bristles thereon.
Figure 4B:
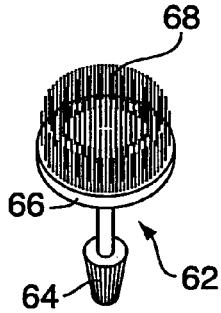

FIGS. 4*a* and 4*b* show a second type of detachable head shown generally at 62, having a tapered tip 64 on one end designed to fit the tapered chuck socket 54 of the hand held device 38. The other end of head 62 includes a disk 66 with axially extending bristles 68. The latter are preferably soft nylon bristles about ¼ to ½ inch long. The disk 66 and the bristles 68 can be formed as an integral member by a known process. The bristles 68 serve as muscle training elements and are moved in a circular motion by head 62.

The purpose of the head with bristles is to smooth out the engrained "memory lines" from facial expressions. The earlier the muscles are toned in life, the greater the benefit will be on delaying the aging process of the face.

Figure 5A:
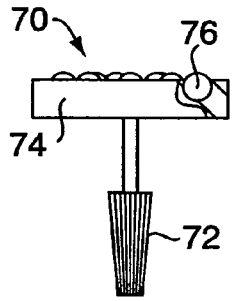
FIGS. 5*a* and 5*b* are elevation and perspective views, respectively, of a removable head having freely rotatable balls thereon.
Figure 5B:
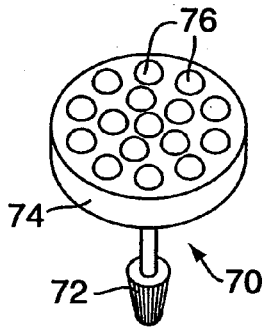

FIGS. 5*a* and 5*b* show a third type of detachable head shown generally at 70, having a tapered tip 72 on one end designed to fit the tapered chuck socket 54 of the hand held device 38. The other end of head 70 includes a disk 74 with freely rollable balls 76. The latter are preferably held in disk 74 in suitable sockets by interference fit. The balls 76 serve as muscle training elements and are moved in a circular motion by head 70.

Figure 6:
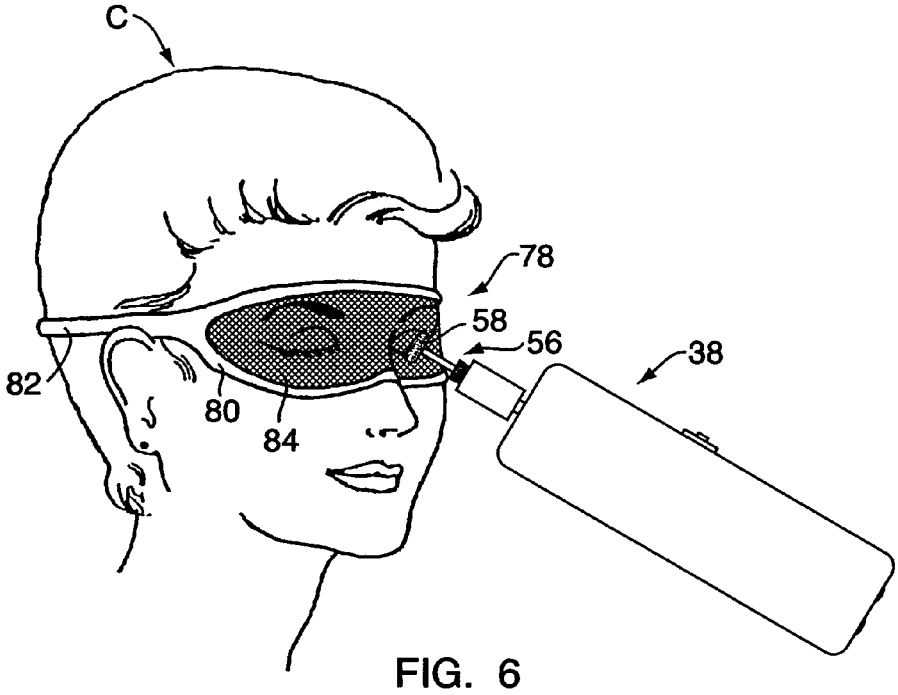
FIG. 6 is a view of a human head with flexible membrane of elastic material in the form of an eye mask together with a hand held device having a soft muscle training head in use.

Referring to FIG. 6 of the drawing, a human head C is represented wearing an eye mask shown generally at 78. The eye mask 78 is supported around the eyes by fabric rim 80, held in place by an elastic strap 82. A flexible membrane 84 of stretchable elastic fabric is attached about its periphery by sewing to the fabric rim 80. The elastic strap and the rim pull the membrane 84 into contact with the face of the user, and the stretchable fabric causes it to conform to the shape of eyes and eyelids.

The hand held device 38 of FIG. 3, or alternatively of any of the other hand held devices yet to be described, is shown with the soft muscle training fiber elements of the rotary tip 58 pressed against the outer surface of membrane 84. The inner surface of membrane 84 is in contact with the eyelids to stabilize and protect the skin while the hand held device is manipulated by the user to stimulate and train the muscles underlying the skin.

Figure 7:
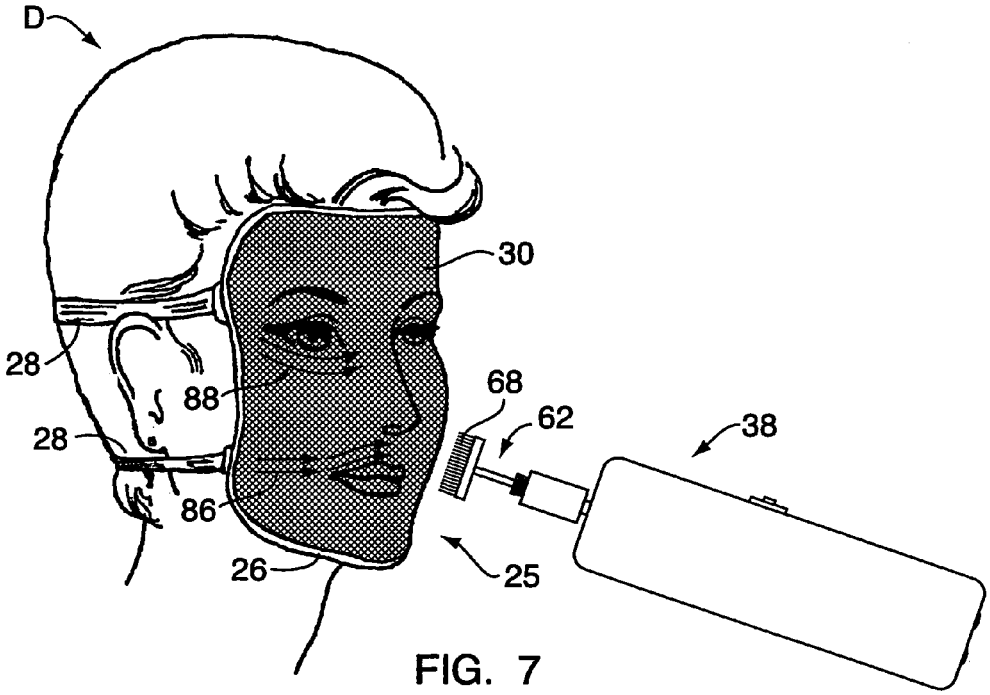
FIG. 7 is a view of a human head with flexible membrane of elastic material in the form of a face mask together with a hand held device having a rotary bristle muscle training head in use.

Referring to FIG. 7 of the drawing, a view of a human head D is shown with flexible membrane of elastic material in the form of a face mask as previously described in FIG. 2, and having the same reference numbers. The hand held device 38 of FIG. 3 is shown, but with the detachable head 62 inserted in the chuck. Bristles 68 are pressed against the outer surface of membrane 20 while the inner surface of membrane 20 contacts the skin. The bristles are rotated by the device 38 as it is moved manually over the membrane by the user. Arrows 86 indicate the preferred direction of movement of the head 62 to train the muscles around the mouth (orbicularis oris). Arrows 88 indicate the preferred direction of movement of the head 62 to train the muscles around the eyes (orbicularis oculi).

Figure 8:
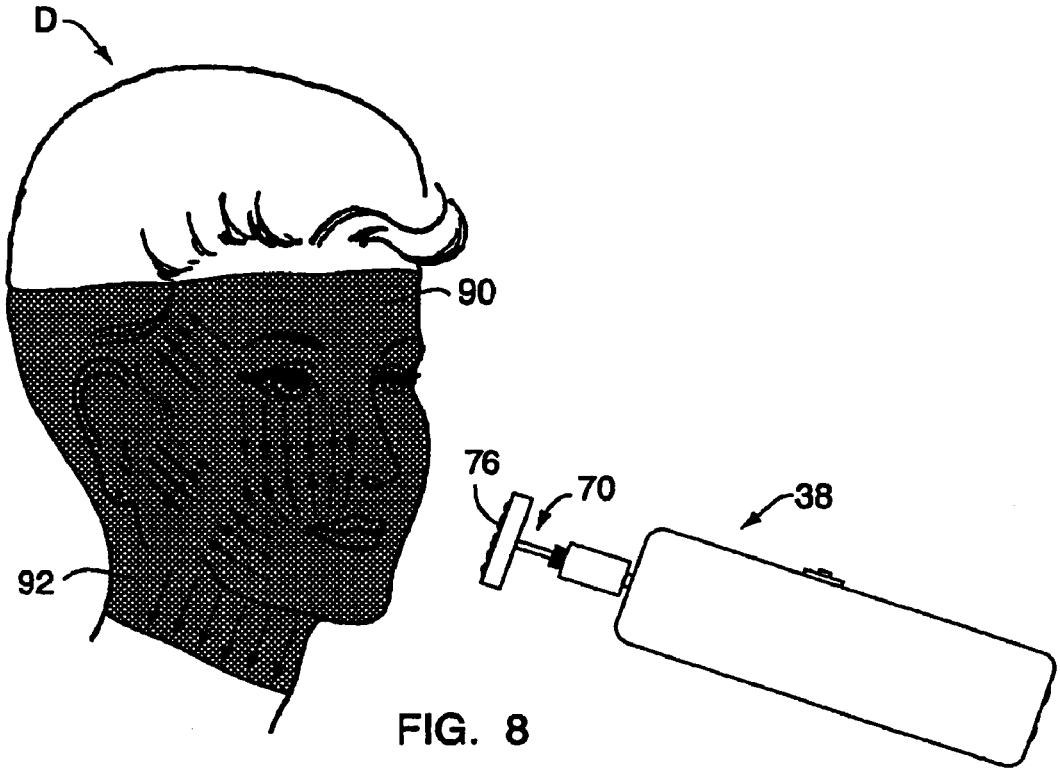
FIG. 8 is a view of a human head with flexible membrane of elastic material in the form of a face mask together with a hand held device having a rotary muscle training head with free rolling balls in use.

Referring to FIG. 8 of the drawing, a view of a human head D is shown with flexible membrane 90 of elastic material in the form of a sleeve 92 pulled down over the head and neck. Since these are less sensitive areas of the skin, more vigorous massaging of the muscles can be done. Detachable head 70 has been substituted in the hand held device 38. The muscle training elements (balls 76) are pressed into contact with the outer surface of the membrane 90. The arrows indicate the movement of the rotating balls over the surface of the membrane, which stabilizes and protects the skin.

Figure 9:
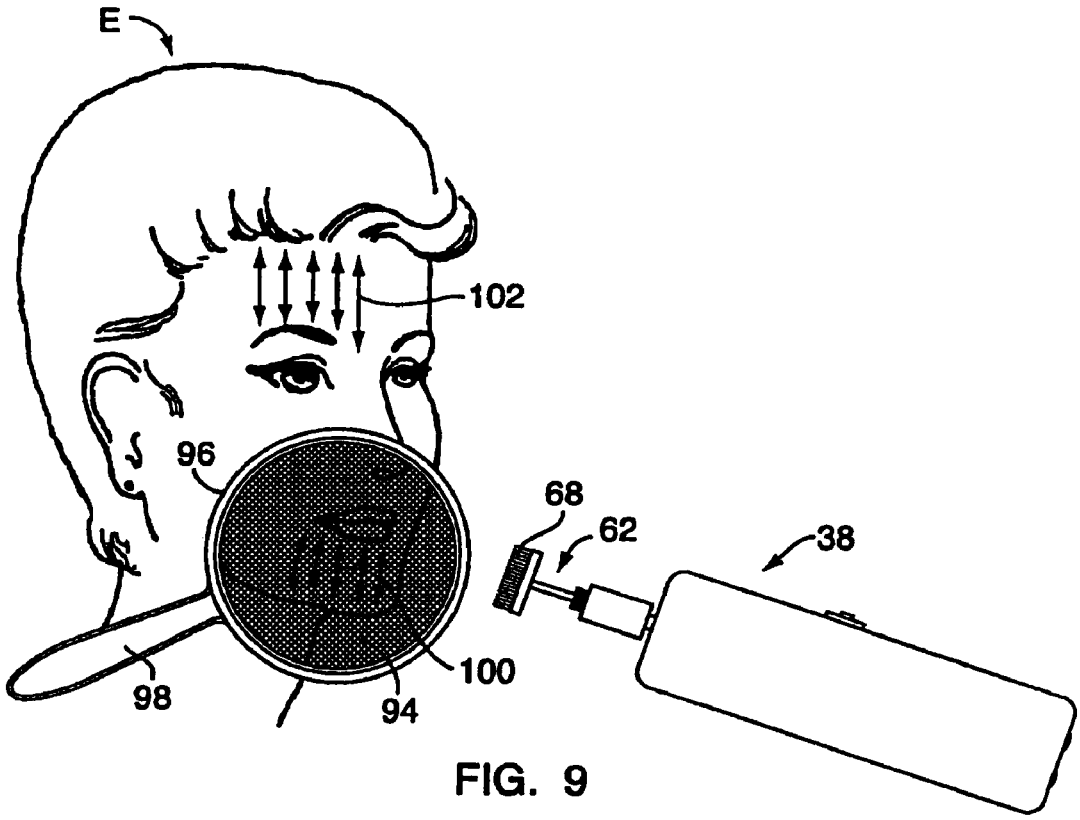
FIG. 9 is a view of a human head with a flexible membrane across a hand-held rim together with a hand held muscle training device having an orbitally moving bristled head.

Referring to FIG. 9 of the drawing, a view of a human head E is shown with flexible membrane 94 of elastic material supported by a hand-held rim 96 attached to a handle 98. Hand held device 38 with detachable head 62 rotates the muscle training elements (bristles 68) in a circular direction. The membrane is placed over the are to be treated and pressed against the face, using the handle 98 held in one hand, so that the membrane conforms to the shape of the face. The other hand manipulates the bristled head as indicated by arrows 100. While this apparatus requires the use of both hands, it offers more flexibility of choice. The hand-held rim may be quickly switched to the forehead to train the frontalis musdes by movement of the bristled head along lines indicated by arrows 102. The head 70 with rotatable balls may also be used in these areas.

Figure 10A:
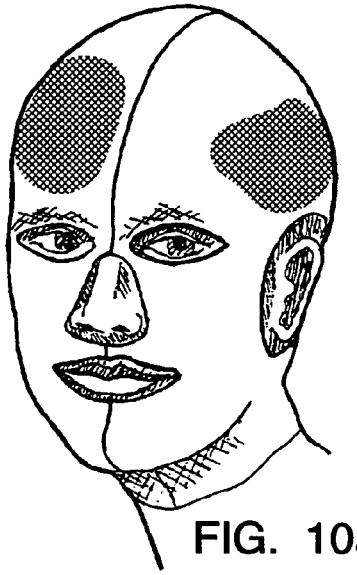
FIGS. 10*a*-10*f* are views of alternate forms of hoods and masks for the flexible membrane.

FIGS. 10*a* through 10*f* illustrate variants of the holders for the flexible membrane. FIG. 10*a* shows a basic pull-over mask (ski-type) with eye, mouth and ear openings of a stretch material of Spandex®, Lycra® or surgical bandage material.

Figure 10B:
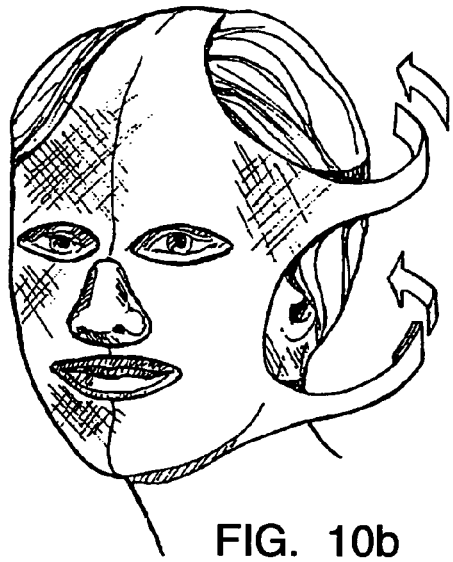

FIG. 10*b* is an abbreviated stretch mask having wrap-around straps with quick attaching Velcro tabs.

Figure 10C:
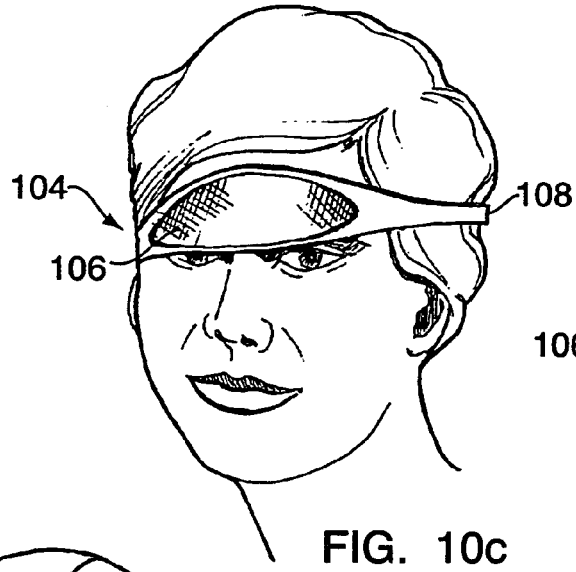
Figure 10D:
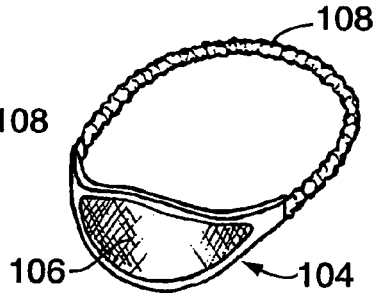

FIGS. 10*c* and 10*d* show a spot treatment mask 104 with a stretch fabric port 106 held in place by an elastic band 108. It can be moved around to various places for selective treatment.

Figure 10E:
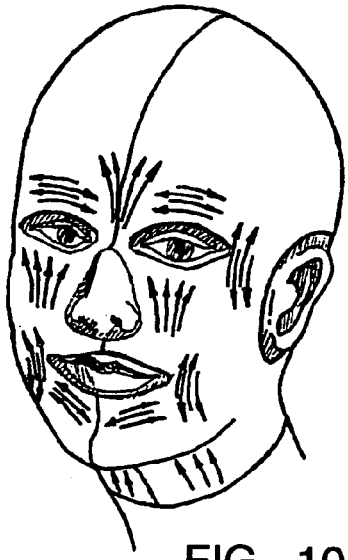
Figure 10F:
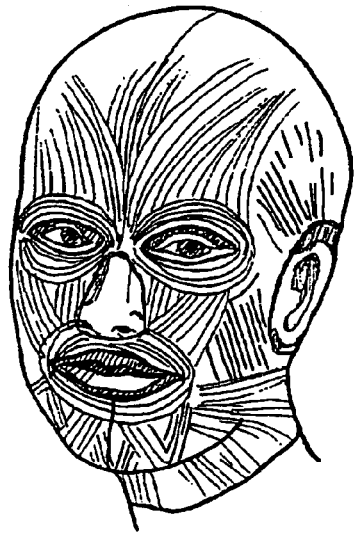

FIG. 10*e* is a pullover mask with preprinted pattern indicating the proper massage patterns. FIG. 10*f* is a similar pull-over mask delineating the normal direction of facial muscles to guide the user.

Figure 11:
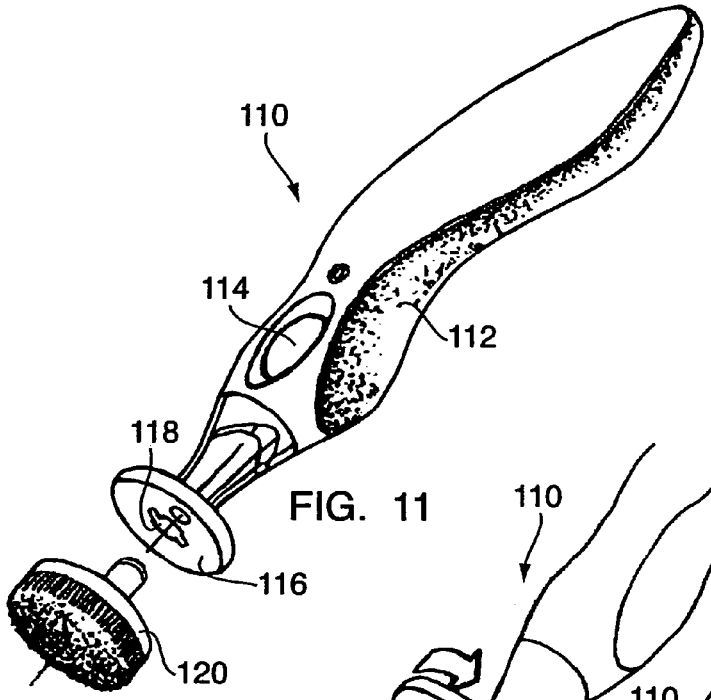
FIG. 11 is a perspective view of a first type of hand-held device that imparts orbital motion to a removable head.

FIG. 11 illustrates an alternate form of hand held facial trainer that provides orbital motion, shown generally at 110. It includes a shaped soft grip 112, a switch 114 for reversing direction of rotation and a rotating disk 116 with off-center hole 118. The shaft of a detachable head fits in hole 118.

Figure 12A:
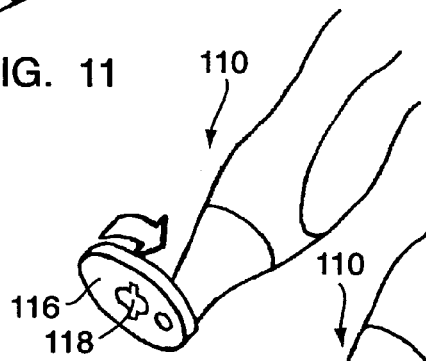
FIGS. 12*a*, 12*b* and 12*c* are perspective views illustrating the operation of the device of FIG. 11.
Figure 12B:
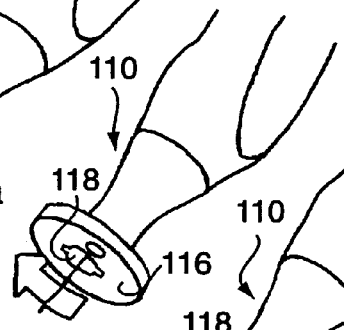
Figure 12C:
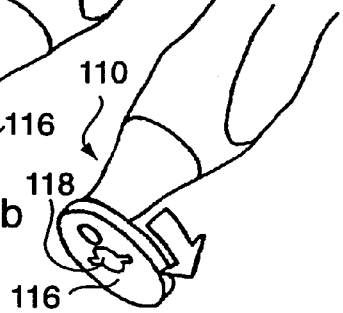

FIGS. 12*a*, 12*b*, and 12*c* show the operation as the disk rotates to three different positions, moving hole 118 in a circular orbit. When the head 120 is in place, the muscle training elements move in a generally circular direction.

Figure 13:
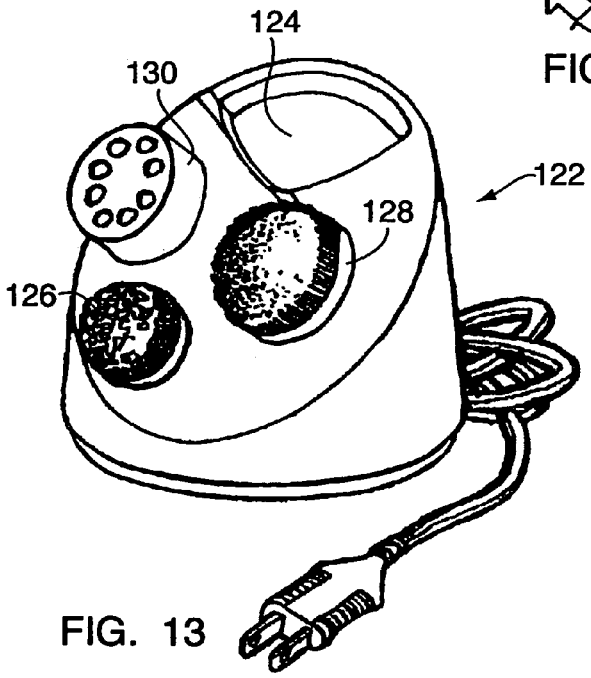
FIG. 13 is a perspective view of a battery-charging stand with receptacles for the removable heads.

FIG. 13 illustrates a variation of a recharging base shown generally at 122. A receptacle 124 holds the device 110 of FIG. 11 to recharge the battery in receptacle 124. The base also serves to hold a soft fleece covered eye massage head 126, a bristled head 128, and a head with freely rotatable balls 130.

Figure 14:
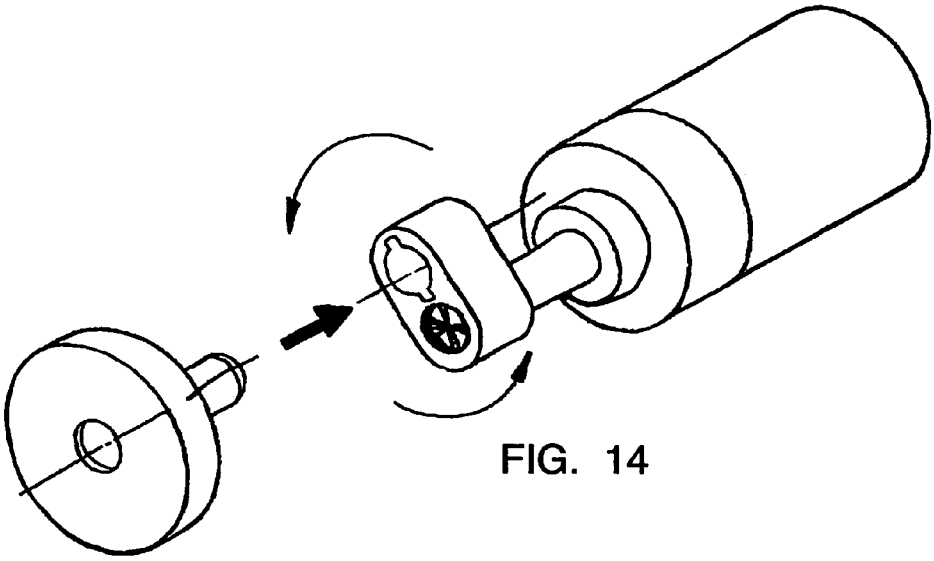
FIG. 14 is a perspective view of a second type of hand-held device that imparts orbital motion to a removable head.
Figure 15A:
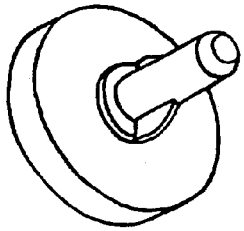
FIGS. 15*a* and 15*b* are variations of removable heads used with the orbital motion device of FIG. 14.
Figure 15B:
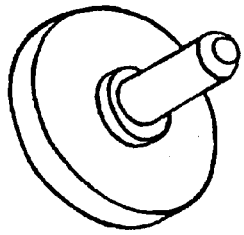

FIG. 14 shows a second type of hand held device providing orbital motion similar to FIG. 11. FIGS. 15*a* and 15*b* illustrate variations of the plate holding the muscle training elements. Plate of FIG. 15*a* imparts friction because it locks to the rotating element and rotates eccentrically. Plate of FIG. 15*b* spins freely within the rotating element and is friction-free.

Figure 16:
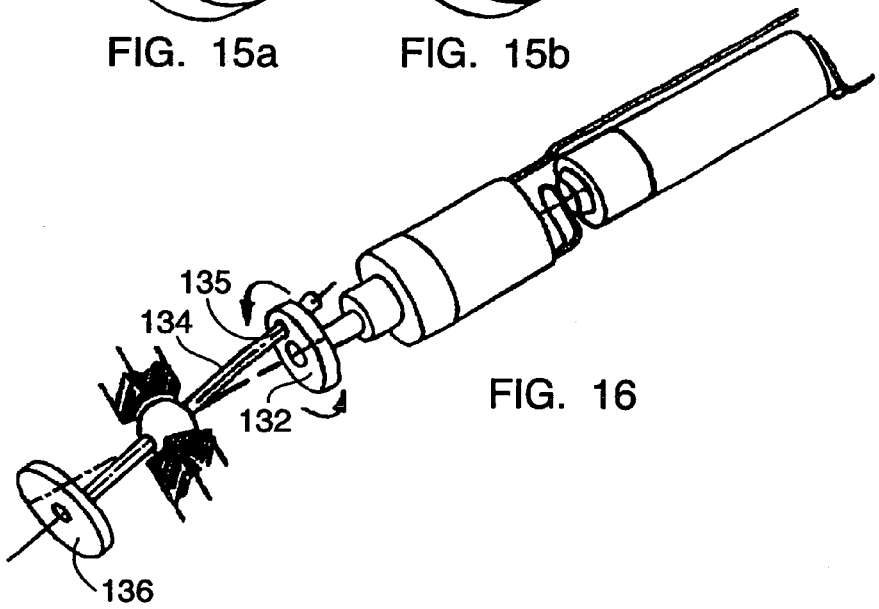
FIG. 16 is a perspective view of a third type of hand-held device that imparts orbital motion to a removable head.

Lastly FIG. 16 illustrates a different type of orbital hand held device providing a nutating motion of the head. A wobble plate 132 moves one end of a shaft 134 in a fixed pivot point 135. This provides a nutating motion of the mounting plate 136. The plate does not rotate, but the muscle training elements move in a generally circular path.

Any of the hand-held devices shown and described above can easily be modified to include heating elements or misting elements to warm or condition the skin through the flexible membrane. The membrane, being woven with interstices, will admit moisture and/or warm air through the interstices while still protecting the delicate skin of the face from the abrasive action of prior art skin massagers, exfoliating, or cleansing devices.

Other modifications will become apparent to those skilled in the art.

What is claimed is:

1. Method for training facial muscles to reduce wrinkles in the skin overlying said facial muscles on the face of a user, said facial muscles comprising a plurality of fibers oriented substantially parallel to one another, said method comprising the steps of (a) providing a flexible membrane of stretchable elastic fabric having an inner surface and an outer surface;

(b) providing a hand-held device having a housing, a power source, a motor connected to be selectively activated by said power source, a motion converter driven by said motor, and a head connected to said motion converter, said head having a plurality of muscle training elements thereon arranged to be moved in a substantially circular direction by said motion converter;

(c) pressing said inner surface of the flexible membrane into contact with a portion of said face;

(d) pressing the muscle training elements on said head against the outer surface of said membrane so that the muscle training elements move in said circular direction both across and along said plurality of fibers; and (e) manipulating said hand-held device over the outer surface of said membrane to stimulate and train said facial muscles while the flexible membrane protects and stabilizes the skin overlying said muscles.

2. The method according to claim 1 where the facial muscles trained are in the eyelids (orbicularis oculi-involuntary).

3. The method according to claim 1 where the facial muscles trained are around the eyes (orbicularis oculi-voluntary).

4. The method according to claim 1 where the facial muscles trained are on the forehead (frontalis).

5. The method according to claim 1 where the facial muscles trained are around the mouth (orbicularis oris), including the lips.

6. The method according to claim 1 where the facial muscles trained are on the neck (platysma) and chin (depressor anguli oris).

7. The method according to claim 1 where the facial muscles trained are on the cheeks (zygomaticus major, zygomaticus minor, risorius, and buccinator).

8. Apparatus for training facial muscles to reduce wrinkles in the skin overlying said facial muscles on the face of a user, comprising the combination of:

a flexible membrane of stretchable elastic fabric having an inner surface and an outer surface, means for holding said inner surface in contact with a portion of the face of said user, and a hand-held device having a housing, a power source, a motor connected to be selectively activated by said power source, a motion converter driven by said motor, and a head connected to said motion converter, said head having a plurality of muscle training elements thereon arranged to be moved in a substantially circular direction by said motion converter, whereby the inner surface of the membrane may be placed in contact with the face and the muscle training elements pressed against the outer surface of the membrane so as to move in said circular direction while the hand-held device is manipulated over the outer surface of the membrane to stimulate and train said facial muscles while the flexible membrane protects and stabilizes the skin overlying said facial muscles.

9. The apparatus according to claim 8 where the flexible membrane comprises Spandex.

10. The apparatus according to claim 8 where the flexible membrane comprises Lycra.

11. The apparatus according to claim 8 where the flexible membrane comprises Dorlastan.

12. The apparatus according to claim 8 where the head on the hand held device is detachable so as to be replaced by another head with a different type of muscle training elements.

13. The apparatus according to claim 8 where said muscle training elements are moved in a substantially circular motion.

14. The apparatus according to claim 8 where the motion converter rotates the head about an axis.

15. The apparatus according to claim 8 where the motion converter orbits the head about an axis.

16. The apparatus according to claim 8 where the muscle training elements are bristles.

17. The apparatus according to claim 8 where the muscle training elements are freely rotatable balls.

18. The apparatus according to claim 8 where the muscle training elements are bumps on fabric.

19. The apparatus according to claim 8 where the muscle training elements are unwoven fibers.

20. The apparatus according to claim 8 where the power source is a rechargeable battery.

21. The apparatus according to claim 8 where the power source is a plug-in adapter with a connecting cord.

22. The apparatus according to claim 8 where the motion converter is a speed reducing gear train providing a rotating output motion.

23. The apparatus according to claim 8 where the motion converter employs an eccentric rotating element providing an orbital output motion.

24. The apparatus according to claim 8 where the motion converter employs a wobble plate and nutating shaft providing an orbital output motion.

25. The apparatus according to claim 8 where the membrane is a hood.

26. The apparatus according to claim 8 where the membrane is a face mask.

27. The apparatus according to claim 8 where the membrane is an eye mask.

28. The apparatus according to claim 8 where the membrane is in a hand-held rim.

29. The apparatus according to claim 8 including a heating element in the hand-held device.

30. The apparatus according to claim 8 including a mist producing element in the hand-held device.

* * * * *